US005600989A

United States Patent [19]

Segal et al.

[11] Patent Number: 5,600,989

[45] Date of Patent: Feb. 11, 1997

[54] METHOD OF AND APPARATUS FOR PROCESSING TUNGSTEN HEAVY ALLOYS FOR KINETIC ENERGY PENETRATORS

[76] Inventors: Vladimir Segal; Leonid Segal, both of 1831-A Wild Oak Cir., Bryan, Tex. 77802

[21] Appl. No.: 490,506

[22] Filed: Jun. 14, 1995

[51] Int. Cl.[6] ..... B21C 23/00

[52] U.S. Cl. ..... 72/253.1; 72/254; 72/256; 72/261

[58] Field of Search ..... 72/253.1, 202, 72/256, 258, 264, 261, 263, 254, 255

[56] References Cited

U.S. PATENT DOCUMENTS 3,580,019 5/1971 Beresnev et al. ..... 72/258
4,249,408 2/1981 Lovell ..... 72/256
4,990,195 2/1991 Spacer et al. ..... 72/202

FOREIGN PATENT DOCUMENTS 1140870 2/1985 U.S.S.R. ..... 72/253.1

*Primary Examiner*—Lowell A. Larson
*Assistant Examiner*—Ed Tolan
*Attorney, Agent, or Firm*—I. Zborovsky

[57] ABSTRACT

A method of enhancing materials for flow localization and manifestation of adiabatic shear bands under high speed loading, comprising the steps of intensively plastically deforming a material at low strain rates by simple shear along prescribed planes a few times into a right and opposite directions with accumulated effective strain of $E_i>1$.

9 Claims, 6 Drawing Sheets

METHOD OF AND APPARATUS FOR PROCESSING TUNGSTEN HEAVY ALLOYS FOR KINETIC ENERGY PENETRATORS

BACKGROUND OF THE INVENTION

The present invention relates to tungsten heavy alloys, and more particularly to thermomechanical processing and manufacturing billets for kinetic energy penetrators, shaped charge liners, hyper-velocity projectiles, and others to enhance ballistic performance of warheads for breaking armor plates.

Penetrator requirements include high density and strength, moderate ductility, large length to diameter ratio geometry, and ability to display localized failure during impact to target (see Magkess, K. S., Jr., "High Strain Rate Deformation Behavior of Kinetic Energy Materials During Ballistic Impact," *Mechanics of Materials,* 18 (1994), 147–154). Depleted uranium penetrators satisfy these requirements but present safety and environmental problems. Therefore, tungsten heavy alloys (WHA) were developed. These alloys are two phase composites produced by powder metallurgy techniques in which the relatively small (10% or less) Ni base matrix phase acts as a binder and ductilizer for dense and strong tungsten grains. Many efforts have been devoted to improve mechanical properties of WHA by optimization of their composition and processing routes (see, Ravichandrau, G., "Influence of Processing on the High Strain Rate Behavior of Refractory Metal: A Review," *Materials and Manufacturing Processes.* V 9, No. 6 (1994); U.S. Pat. Nos. 4,990,195; 5,028,756; 5,306,364; and others). However, ballistic performance of WHA remains noticeably poorer than that of depleted uranium because tungsten heavy alloys do not exhibit localized flow and mushroom considerably during penetration of armor (see, Andrew, S. P., and Calgiuri, R. D., "A Review of Penetration Mechanisms and Dynamic Properties of Tungsten and Depleted Uranium Penetrators," *Tungsten and Tungsten Alloys Recent advance,* Eds. A Crowsen and E. Chen, Warrendale, PA, 1991). Also, attempts to induce localized deformation by replacing Ni with more adiabatic sensitive metals, development of the preferable texture into tungsten phase, or thermomechanical processing with moderate cold working (swaging and extrusion) were not fully successful.

Another approach is a structural modification of the binder phase by severe plastic deformation to achieve the highest level of strengthening and develop anisotropy for flow and fracture in the desired direction. Among the existing metalworking methods only the recently developed equal channel angular extrusion technique (ECAE) is the most suitable for that processing (see, Invention Certificate of the USSR No. 575892; Segal, V. M., et al., "Plastic Working of Metals by Simple Shear," *Russian Metallurgy,* 1 (1981), 115; Segal, V. M. "Simple Shear as a Metalworking Process for Advanced Materials Technology," First International Conference on Processing Materials for properties, Honolulu, 1993, 947–950). The known ECAE process and apparatus are shown in FIG. 1 (see, Segal, V. M., "Working of Metals by Simple Shear Deformation process," Proceedings Y International Aluminum Extrusion Technology Seminar, Chicago, 1992, 403–406). A well lubricated billet 1 is extruded by punch 2 through two meeting channels 3, 4 of a die 5. As channel cross-section areas are identical to that of the original billet, the billet is deformed by simple shear along the crossing plane of the channels. Following extrusion, the punch 2 returns to the initial position, and the worked billet 1 may be withdrawn from the channel 4. This operation can be repeated numerous times with changing a billet orientation between passes. Therefore ECAE offers opportunity to apply intensive and uniform strains to massive billets.

However, the known method and apparatus of equal channel angular extrusion are not without limitations. More particularly, their application for processing of tungsten heavy alloy penetrators presents a few problems.

First, the known methods of multistep equal channel angular extrusion provide the production of either strongly elongated grain structures or equiform grain structures. Elongated grain structures are not disposed for adiabatic localization and difficult in application to WHA as the dominant phase of the alloy is hard and non-deformable tungsten grains of near spherical shape. On the other hand, equiform grain structures produced by alteration of the shear direction along the same plane are suitable for adiabatic localization and processing WHA but exhibit strong anisotropy and asymmetrical flow along one set of slip lines during subsequent loading. This tendency increases with the increase of strain rate that will result in deviation of impact direction and ricochet of penetrators under interaction to a target. In addition, for ballistic performance penetrators should posses the special symmetry and anisotropy of planes under an optimal angle to the billet axis that can not be developed with known processing.

First, as penetrators are long rods of high strength material, friction inside the channel 3 (FIG. 1) significantly increases punch pressure. To eliminate this problem in the most advanced die design shown in FIGS. 1, 2, the first channel 3 has three movable walls fabricated into a slider 6. But in this case lubricant is forced to flow through small clearance "a" between the slider 6 end protrusion 7 covering the channel 3. That results in very poor friction condition and material sticking along the bottom wall of the second channel 4.

Also, an angle between adiabatic shear bands and a penetrator axis is of about 60°. For that reason the protrusion 7 should have a sharp angle $\phi$ of insufficient strength, and may be destroyed during processing.

SUMMARY OF THE INVENTION

In accordance with the invention, the new method enhances materials for flow localization and manifestation of symmetrically located adiabatic shear bands under high speed loading, comprising the steps of intensively plastically deforming a material by simple shear along prescribed planes a few times into a right and opposite directions which are defined by a special system of a billet orientation between successive steps with accumulated effective strain of $E_i>1$.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Preferred embodiments of the invention will now be described with reference to the accompanying Figures.

The present invention includes a method and apparatus for processing tungsten heavy alloy billets for penetrators, and manufacturing thereof.

Figure 3:
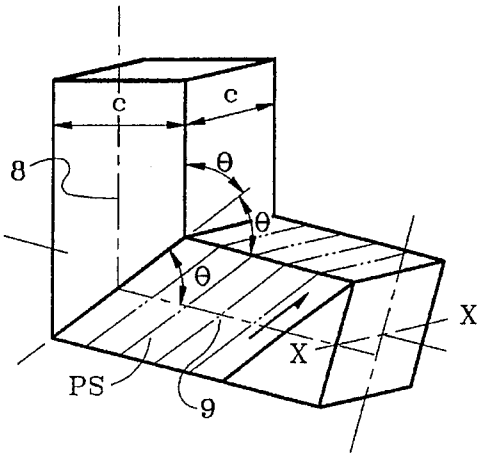
FIG. 3 shows an orientation of shear planes against billet axes after ECAE.

The method of the invention explores disclosed effect of intensive simple shear deformation into a desired direction on plastic flow instability during subsequent loading. This stimulated instability is the result of ultrafine structure, texture and oriented defects (dislocations, microcracks) induced by simple shear. Experiments with different metals and alloys processed by ECAE have shown that for all cases of additional deformation there is a strong tendency for following flow along planes and direction of preliminary shear. The tendency is more evident when simple shear is alternatively performed into right and opposite directions with accumulated effective strain of $E_i>1$. During tensile testing of such samples it results in elliptical neck oriented along the shear plane. Typical results for a neck ellipticity coefficient (a/b) where "a" is the large ellipse axis and "b" is the small ellipse axis versus effective strain ($E_i$) are shown in FIG. 3 for low carbon steel. A curve 1 presents the alternative shear while a curve 2 presents the unidirectional shear. Preferably flow is maximum at $E_i \sim 1$ and conserves at that level for alternative shear but decreases progressively for unidirectional shear.

Induced material ability for localization becomes especially strong with increased speed of subsequent loading due to high concentration of deformation heating, and when additional loading is performed in the same manner as the preliminary one. In these cases experiments have demonstrated that adiabatic bands are detected for many materials which usually do not show disposition to localization, and at strain rates those are from 10 to 100 times less than that of dynamic testing.

There are additional reasons favorable for flow localization in WHA with this processing method such as reorientation of non-deformable tungsten grains to more suitable position along shear planes and extremely strong hardening of matrix phase even at enough low average strains of material. Also, hard tungsten grains increase flow stress of the ductile phase on a few times that makes material much more sensitive to deformation heating at high speed loading.

Embodiments of the processing method are targeted for optimal exploration of these effect to stimulate penetrator localized flow and fracture during impact to a target. They include the unique selection of shear planes and directions and temperature-strain rate conditions during equal channel angular extrusion WHA billets for penetrators (see an intermediate position in FIG. 3). A billet part 8 at the original condition is located inside the first channel while the processed billet part 9 enters the second channel. It may be seen that the angle (θ) between the shear planes PS and the billet axis is equal to a half of the angle (2θ) between channels. According to one embodiment of the invention an optimal orientation of the shear planes during processing is the same as that of adiabatic bands under impact loading of penetrators. Therefore, the angle (θ) has to be determined by dynamic testing of penetrators. Then, the angle (2θ) between channels may be calculated. From published results it follows $45°<\theta<60°$ that gives for the angle between the channels $90°<2\theta<120°$. As we will see later, in some cases the angle (2θ) should be corrected to an increase.

Figure 4A:
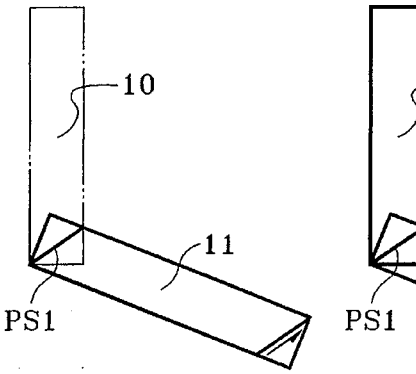
FIGS. 4A–D show a method of penetrator processing to produce plastic instability with symmetry of surfaces.
Figure 4B:
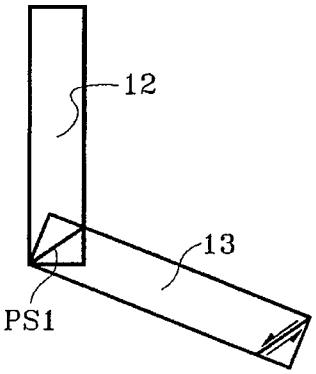
Figure 4C:
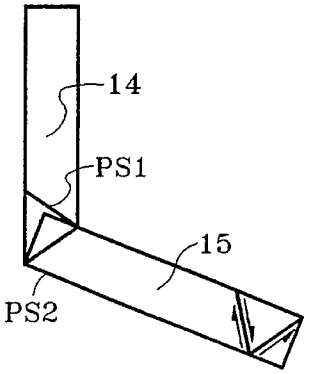
Figure 4D:
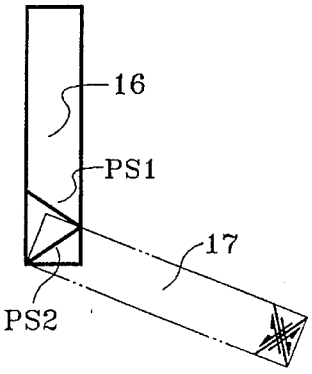

But unsymmetrical flow of penetrator along one system of shear planes PS shown in FIG. 3 will result in deviation of impact direction and ricochet. Therefore, the another embodiment of the method is development of the special symmetry of shear planes shown in FIGS. 4A–D. This optimal processing route of penetrator billets includes multistep ECAE with changing of the billet orientation between passes. At the first pass (FIG. 4A) the initial billet orientation 10 is arbitrary. This pass determines one system of shear planes PS1 in the processed billet 11. The billet positioning 12 at the second pass (FIG. 6B) is performed with conservation of the extrusion direction and rotation of the billet 180° around its longitudinal axis. Therefore, orientation of shear planes in the processed billet 13 is the same as PS1 but the shear direction is opposite to the first pass.

At the third pass (FIG. 4C), the initial billet orientation 14 is identical to that of the second pass. As a result, simple shear occurs along the second system of shear planes PS2 located symmetrically to PS1 (see the processed billet 15 in FIG. 4C).

At the fourth pass (FIG. 4D), the billet orientation 16 is again changed similarly to the second pass that is with conservation of the extrusion direction and rotation of the billet 180° about its longitudinal axis. That way the processing is performed along the second system of shear planes PS2 in the direction opposite to that at the third pass (see the processed billet 17 in FIG. 4D).

Figure 5:
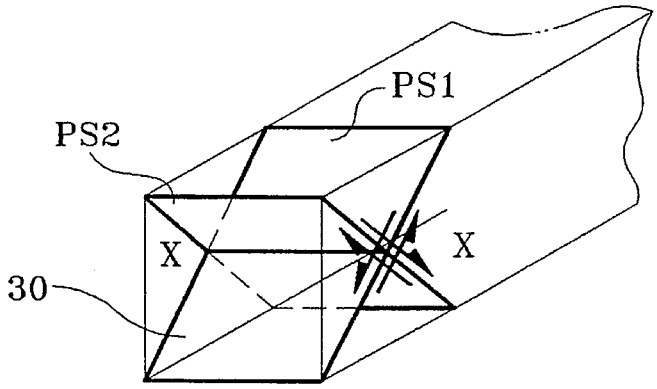
FIG. 5 shows shear planes for the processing method of FIGS. 4A–D.
Figure 6A:
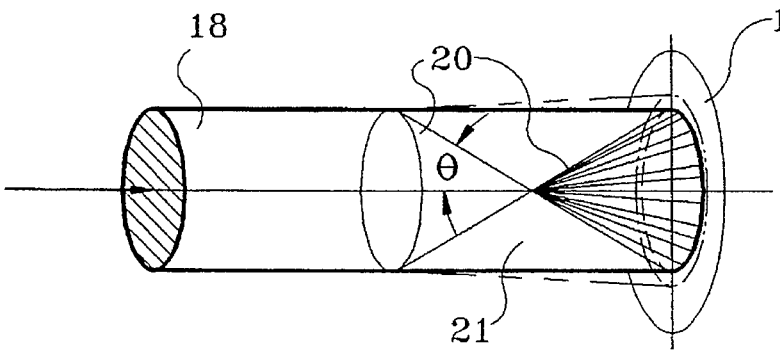
Fig-6A Prior Art
FIGS. 6A, B show adiabatic flow localization during impact loading of penetrators with axial symmetry (A) and with symmetry of planes (B)
Figure 6B:
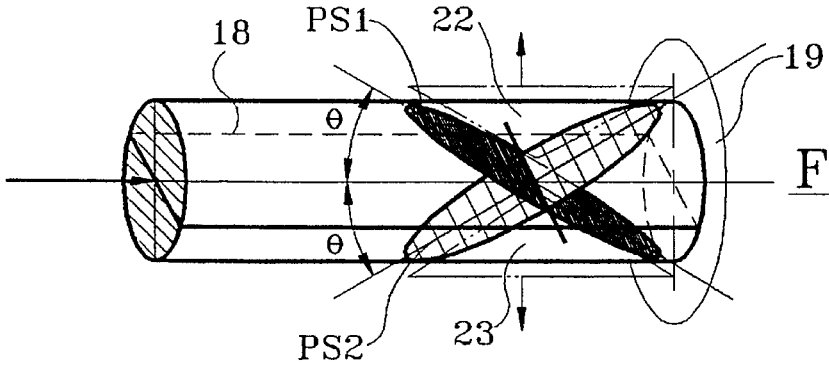

That processing route can be repeated a few times with total number of passes divisible to four. The final result is development of two equivalent systems of shear planes PS1 and PS2 oriented symmetrically against the longitudinal billet plane X—X (see FIG. 5). Flow localization along these systems corresponds to the symmetry of planes that provides central impact and significantly increase penetrator performance in comparison to the axial symmetry for known processing methods of penetrators. FIG. 6 confirms that conclusion. During impact of penetrator 18 having axial symmetry of properties to the target 19 adiabatic localization begins along conical surfaces 0 (FIG 6A). However, the tapered volume 21 cannot move as a rigid whole, and its deformation develops high compressive stresses on the surface 20. Following the pass of least resistance, localized shear will dissipate inside volume 21 that results in mushrooming and decreasing of penetration. As against that, in the case symmetry of planes developed by the method of the invention adiabatic shear takes place along flat surfaces PS1 and PS2 (FIG. 6B). Therefore, during impact, volumes 22, 23 move as a rigid whole without resistance and interaction to the target 19 providing high penetration.

Another embodiment of the method is the selection of temperature-strain rate conditions for ECAE of heavy alloys. To provide strong effect of processing on structural changes of the matrix phase, extrusion should be performed at room or ambient temperatures less than the recrystallization temperature of that phase but sufficient one to eliminate breakage. On the other hand, strain rate should be low enough to avoid flow localization under processing at each pass. This processing conserves an original spherical shape tungsten grains and reorients them to the more favorable position for following shear along the same planes.

Figure 7:
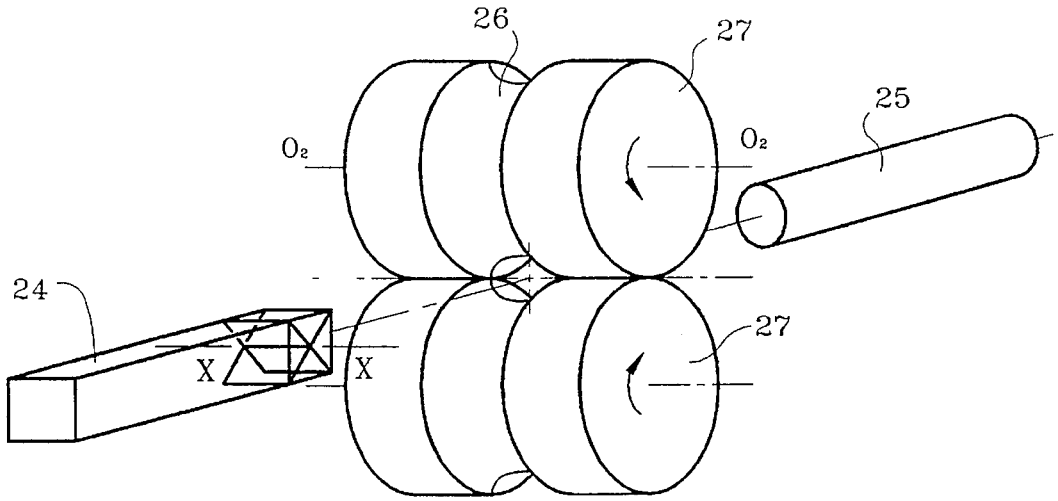
FIG. 7 shows post-extrusion rolling in grooves to produce penetrator billets of round cross-section areas.
Figure 8:
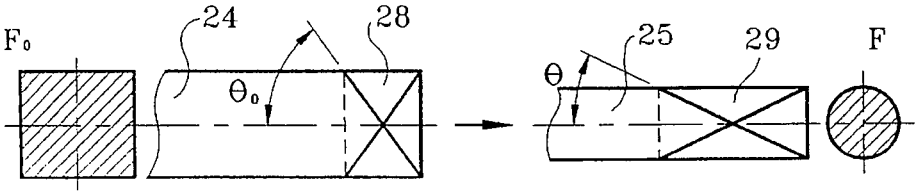
FIGS. 8A, B show reorientation of shear planes during post-extrusion rolling.

Next embodiment of the method is post-extrusion deformation of processed billets 24 of square cross-section areas into billet 25 of the round cross-section areas by rolling in grooved passes 26 of rolls 27 (FIG. 7). That rolling step may be performed in a few passes with rotation of the billet 90° about its longitudinal axis (only one pass is shown in FIG. 7). As additional deformation is insignificant in comparison with ECAE, to provide its predominant development along fixed planes PS1 and PS2, the billet orientation at the first rolling pass should be the same as after the last pass of extrusion. For that goal the plane of symmetry of systems PS1 and PS2 is located parallel to the axes of rolls $O_2O_2$ (FIG. 7). In that case the necessary orientation (θ) of adiabatic bands in penetrator is achieved by correcting the angle ($2\theta_0$) between channels of ECAE (FIG. 8). In accordance with transformation of the specific volume 28 of the billet 24 before rolling (FIG. 8A) into the equivalent volume 29 of the rolled billet 25 (FIG. 8B) those angles are connected by equation:

$$\tan \theta_0 = 0.89\,(F_0/F)^{2/3} \tan \theta$$

wherein $2\theta_0$ is a corrective angle between the channels,

θ is the angle between the adiabatic shear bands and the penetrator axis, $F_0$ is a billet square cross-section area after the step of extrusion, F is a billet round cross-section area after the post-extrusion rolling.

Post-extrusion rolling reduces machining operations during penetrator fabrication, saves of about 20% expensive WHA, and increases a billet length.

Figure 9:
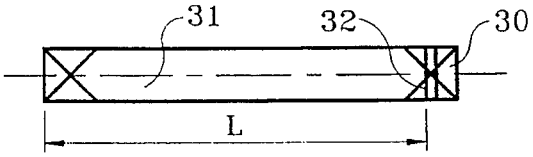
FIG. 9 shows cutting off penetrators from one-piece billets.
Figure 10:
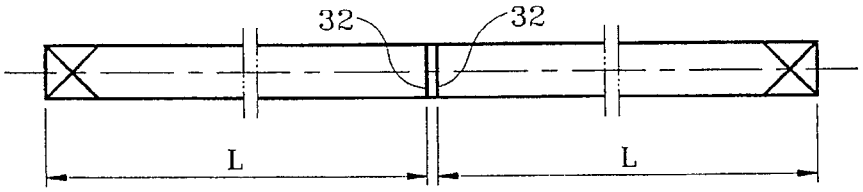
FIG. 10 shows cutting up penetrators from multi-piece billets.
Figure 11B:
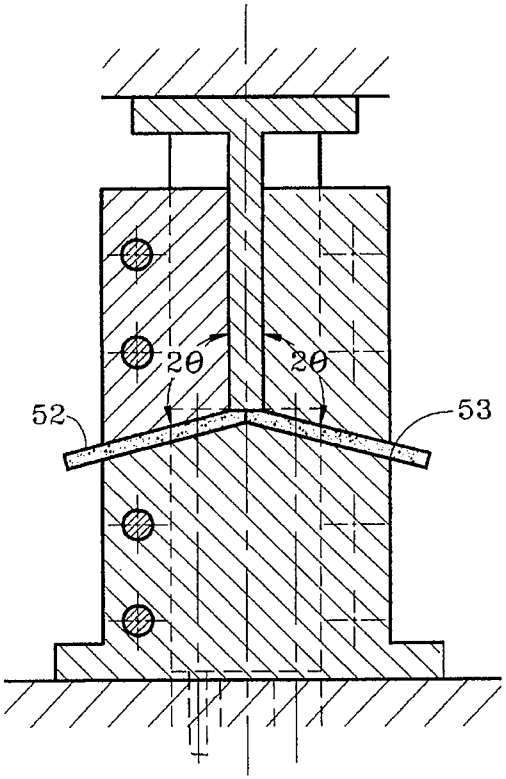
FIGS. 11A, B are a cross-sectional view of an extrusion apparatus in accordance with an embodiment of the invention at the initial position (A) and after completing of extrusion (B)
Figure 11A:
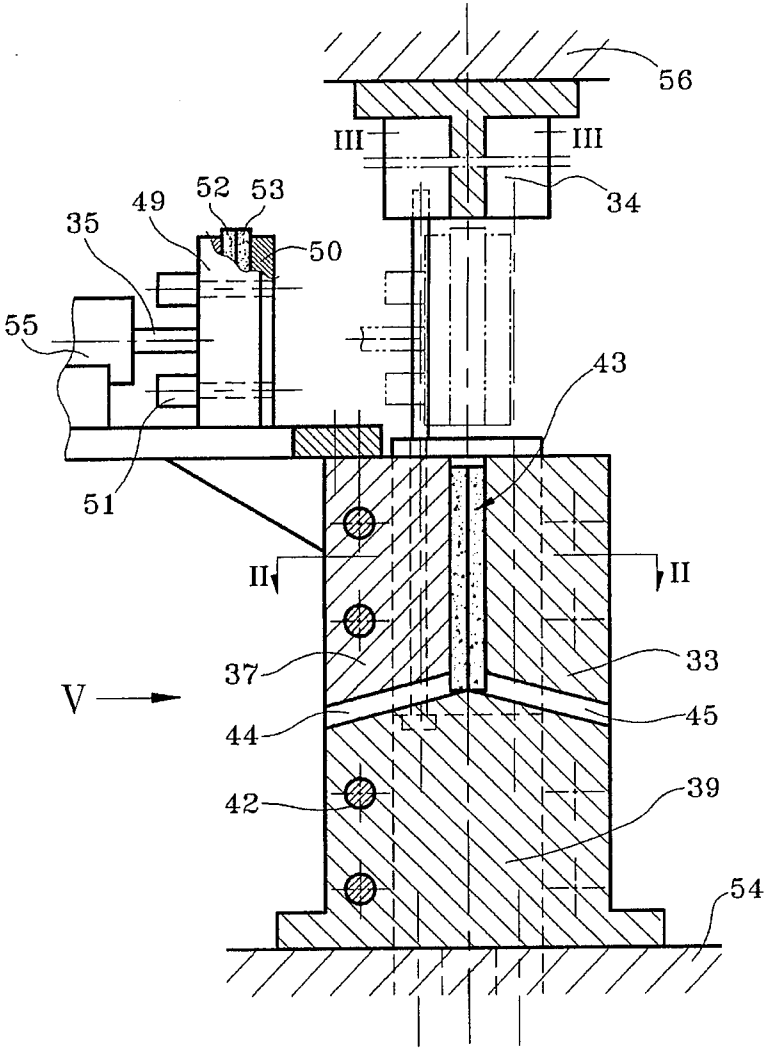

Another embodiment of the method is penetrator fabrication from processed billets. As it can be seen from FIGS. 5 and 9, prismatic volumes 30 at billet ends stay undeformed during ECAE. But there are especially high requirements to the penetrator forward end interacting to the target while such requirements to the penetrator backward end are comparatively low. It allows to cut off only one defected end 30 of the billet 31 destined for fabrication one penetrator of the length L (FIG. 9), or cut up the measured length L from billets destined for a few penetrators (a case of two pieces billet is shown in FIG. 10). Then cutting planes 32 are marked, and penetrator forward ends are located at these planes under fabrication. That operation saves up to 5–7% of material and provide high quality of products.

Figure 13:
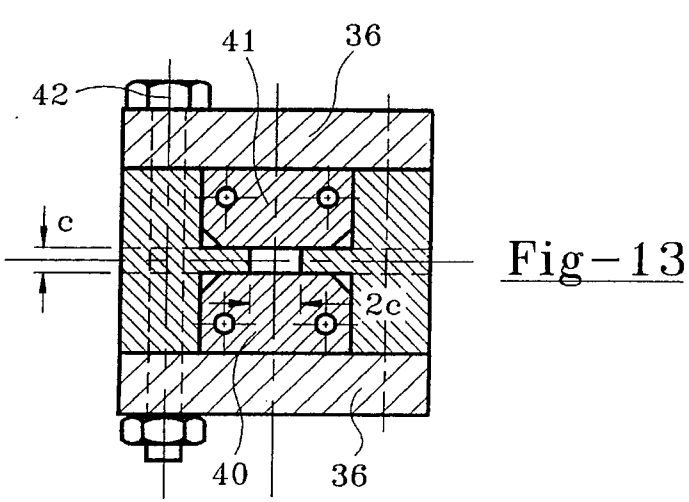
FIG. 13 is a cross-sectional view of section II—II of FIG. 11A.
Figure 14:
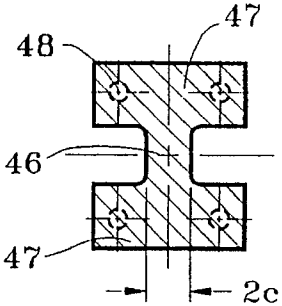
FIG. 14 is a cross-sectional view of section III—III of FIG. 11A.
Figure 12:
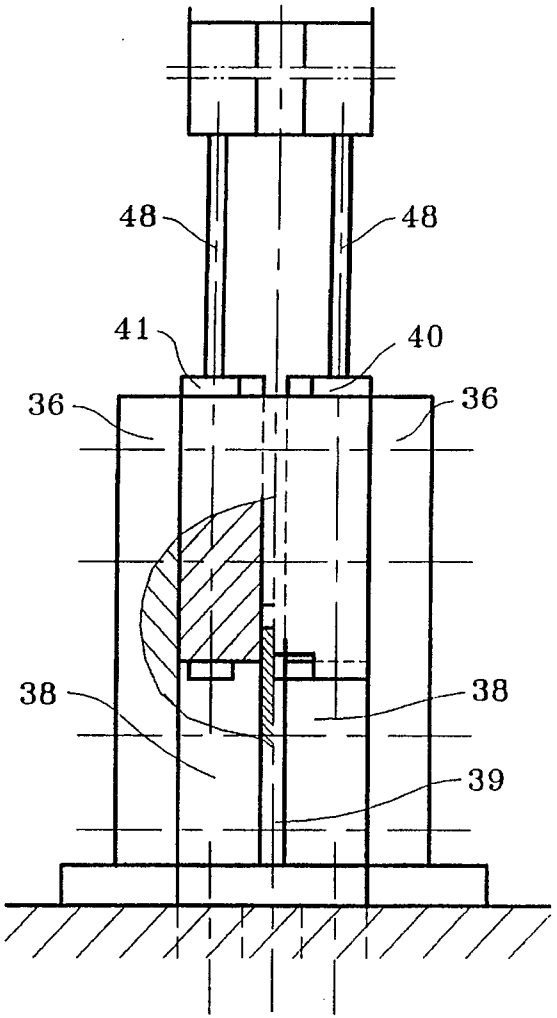
FIG. 12 is a side view of the extrusion apparatus of FIG. 11A taken in the direction V.

The invention includes also an apparatus for equal channel angular extrusion of long billets of high strength materials. The apparatus shown in FIGS. 11–14 comprises a die 33, punch block 34, and loading mechanism 35. The die 33 comprises two side plates 36, forward plates 37, intermediate plates 38, a support 39 and two sliders 40, 41. Dieparts are assembled together with coupling studs 42. Forward plates 37 have inside angles (2θ) while the support 39 has a dihedral angle 2(180°–2θ) at its vertex. That way one vertical channel 43 is formed between forward plates 37 and sliders 40, 41, and two opposite-directed horizontal channels 44, 45 are formed between forward plates 37, the support 39 and sliders 40, 41. The angle between the vertical channel 43 and each of horizontal channels 44, 45 is (2θ). All three channels 43, 44, 45 have the same width "c" of cross-sections (FIG. 13) which corresponds to the billet width (FIG. 3). A cross-section height of the horizontal channels 44, 45 also corresponds to the billet dimension but the cross-section height of the vertical channel 43 is twice as much as the corresponding billet dimension.

The punch 34 of I-beam cross-section (FIG. 14) interacts to the die 33. A thin part 46 of a punch 34 covers the vertical channel 43, and wide parts 47 cover sliders 40, 41 being connected to them by drafts 48. The billet loading mechanism 35 comprises a housing 49, clamp 50 provided with cylinders 51, and feeding cylinder 55. The die 33 is mounted at a pres table 54, and punch 34 is fixed to a press ram 56.

At the initial position (FIG. 11A) the press ram 56, punch 34, and sliders 40, 41 are lifted up, and the loading mechanism is outside of press working zone. The clamp 50 is open and cavity inside the housing 49 corresponds to the vertical channel 43. In this position two well lubricated billets 52, 53 are inserted inside housing 49, clamped by cylinder 51, and then fed to the press (see dot-dash lines in FIG. 11A). Special attention should be paid to lubrication of coupling surfaces of billets 52, 53 on which may be deposited solid lubrication coating. After releasing of the clamp 50 both billets move down into the channel 43, the loading mechanism 35 returns to the original position and the press is put into operation.

At the beginning stage of stroke drafts 48 release sliders 40, 41 but they continue to stay at the top position owing to friction into its guides. Then the punch 34 enters the channel 43, gets in touch to sliders 40, 41, and extrudes billets 52, 53 into horizontal channels 44 and 45, respectively. During ECAE, similarly to hydro-extrusion, lubricant is locked between billets 52, 53 and tool, and uniformly fed together with billets on contact surface of the support 39. That provides low friction and eliminates material sticking along a bottom wall of channels 40, 41. Also, as the vertex angle of the support 39 is obtuse one and symmetrically loaded, all die parts have high strength and reliability. After completing stroke (FIG. 11B) the ram 56, punch 34, drafts 48 and sliders 40, 41 retreats, and processed billets 52, 53 are withdrawn from the die.

Figure 1:
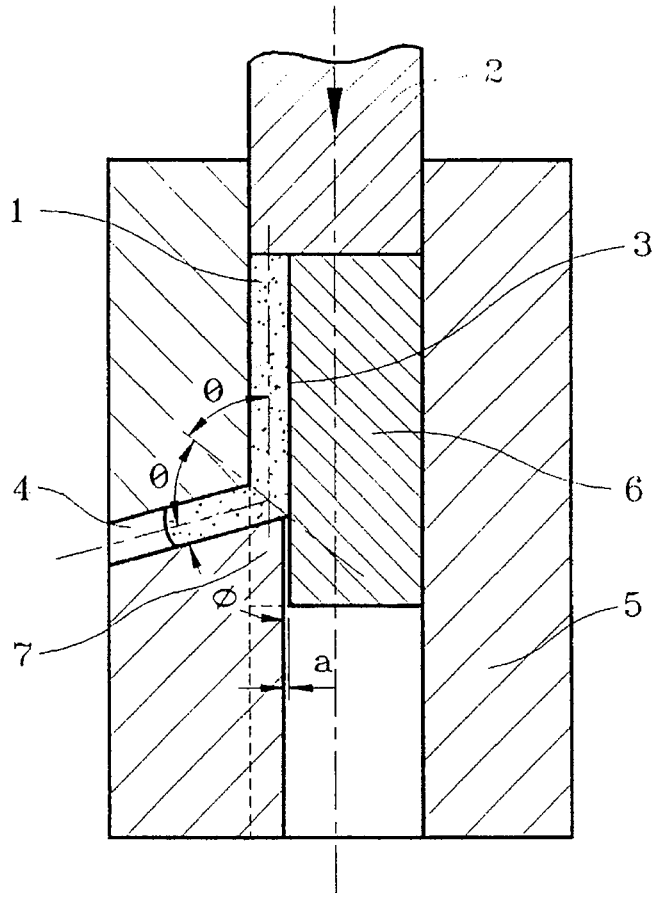
Fig-1 Prior Art
FIG. 1 is a cross-sectional view of the known die for equal channel angular extrusion of long billets.
Figure 2:
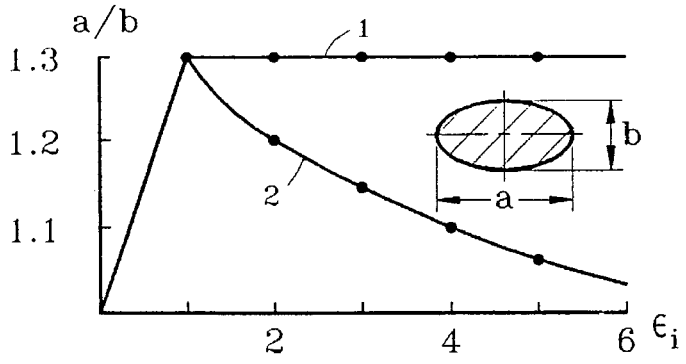
FIG. 2 is a diagram for neck ellipticity (a/b) after tensile testing of mild steel preliminarily processed by simple shear with different effective strains ($E_i$) into two opposite directions (curve 1) and into the same direction (curve 2)

Therefore, the apparatus of the invention eliminates friction along three walls of the vertical channel 43 owing to movable sliders 40, 41 and absence of sliding between billets. In comparison with the known die (FIG. 1), this apparatus provides process stability, tool life for ECAE of long billets of high strength materials, simultaneous processing of two billets per press stroke, and may be used for angles (2θ) between channels much more than 90°.

Advantages of processing method of the invention are significant increase of penetrator performance and their effective manufacturing.

It will be understood that each of the elements described above, or two or more together, may also find a useful application in other types of methods and constructions differing from the types described above.

While the invention has been illustrated and described as embodied in a method and apparatus for processing tungsten heavy alloys for kinetic energy penetrators, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method for processing billets of tungsten heavy alloys composed essentially of tungsten grains bonded by a matrix phase, for kinetic energy penetrators displaying adiabatic shear bands under impact, and having improved ballistic performance, the method comprising the steps of:

a) determining, by observation of ballistic testing of penetrators of the same alloy an angle between adiabatic shear bands and the penetrator axis;

b) providing a tool having a vertical channel and a cross-section which corresponds to the cross-section of the billet, and a horizontal channel of the identical cross-sectional, being contiguous with and oriented to the vertical channel at an angle twice as much as the angle between the adiabatic shear bands and the penetrator axis;

c) inserting the billet into the vertical channel and extruding the billet into the horizontal channel at a temperature which is less than a recrystallization temperature of the matrix phase and at strain rates which are sufficient to eliminate material breakage and flow localization during the steps of extrusion;

d) withdrawing the billet from the horizontal channel;

e) repeating step c), with conservation of an extrusion direction of the billet and rotating the billet for 180° about a billet axis before the step of inserting;

f) repeating the steps c), d) with the same billet orientation as at the step e);

g) repeating the steps c), d) with conservation of the extrusion direction of the billet and rotating the billet for 180° about the billet axis before the step of inserting.

2. A method as defined in claim 1 and further comprising the step of repeating the processing a few times with a total number of steps divisible to four.

3. A method as defined in claim 1; and further comprising the steps of post-extrusion deformation performed by rolling into grooved passes of rolls so as to provide a change of a square billet cross-section to a round billet cross-section; conservation of a billet orientation at a first of the passes of the post-extrusion rolling the same as a billet orientation at a last of the steps of extruding; correcting an angle between the first and the second extrusion channels with equation:

$$\tan \theta_0 = 0.89\,(F_o/F)^{2/3} \tan \theta$$

wherein $2\theta_0$ is a corrective angle between the channels,

θ is an angle between the adiabatic shear bands and the penetrator axis, $F_0$ is a billet square cross-section area after the step of extrusion, F is a billet round cross-section area after the post-extrusion.

4. A method as defined in claims 1 and 2, further comprising the step of forming a penetrator from the billet and including the steps of cutting off a defected end of the billet per one penetrator, marking up cutting surfaces of billets, and locating a penetrator forward end at the marked up surface of the billet.

5. A method as defined in claims 1 and 2, further comprising the step of forming a penetrator from the billet and including the steps of cutting up a measured piece of the billet per a few penetrators, marking up cutting surfaces of billets, and locating a penetrator forward end at the marked up surface of the billet.

6. An apparatus for equal channel angular extrusion of billets of square cross-section area, comprising a vertical channel having a rectangular cross-section with a width corresponding to a billet cross-section and a thickness which is twice as much as the corresponding billet cross-section; two horizontal channels having square cross-sections corresponding to the billet cross-section, being continuous with and oriented in opposite directions at an angle relative to the vertical channel; two movable sliders defining side walls of the vertical and horizontal channels; a punch covering cross-sections of the vertical channel and sliders arranged to simultaneously extrude two billets from the vertical channel into the first and second horizontal channels, respectively; and means for inserting two billets side-by-side into the vertical channel.

7. A method of processing billets of square cross-section area of tungsten heavy alloys composed essentially of tungsten grains bonded by a matrix phase, for kinetic energy penetrators displaying adiabatic shear bands under impact and having improved ballistic performance, the method comprising the steps or inserting a billet into a first channel having a cross-section of the billet; extruding the billet from the first channel into a second channel having a cross-section corresponding to the cross-section of the billet and being continuous with and oriented at an angle relative to the first channel; repeating the steps of insertion and extruding the billet; dynamically testing a penetrator and determining an angle between adiabatic shear bands and a penetrator axis; forming an angle between the channels twice as much as the angle between the adiabatic shear bands and the penetrator axis; performing a total of four steps of the inserting and extruding the billet with conservation of direction at each extrusion step and rotation of the billet 180° about its longitudinal axis before the insertion of the billet into the first channel at a second one of the steps of extrusion and at a fourth one of the steps of extrusion; performing post-extrusion deformation by rolling into grooved passes of round cross-section area of rolls so as to provide a billet orientation at a first of the passes of the post-extrusion rolling the same as a billet orientation at a last of the steps of extruding; and correcting an angle between the first and the second extrusion channels with equation:

$$\tan \theta_0 = 0.89\,(F_o/f)^{2/3} \tan \theta$$

wherein $2\theta_0$ is a corrective angle between the channels,

θ is an angle between the adiabatic shear bands and the penetrator axis, $F_0$ is a billet square cross-section area after the step of extrusion, F is a billet round cross-section area alter the post-extrusion.

8. A method of processing billets of tungsten heavy alloys composed essentially of tungsten grains bonded by a matrix phase, for kinetic energy penetrators displaying adiabatic shear bands under impact and having improved ballistic performance, the method comprising the steps of inserting a billet into a first channel having a cross-section-of the billet; extruding the billet from the first channel into a second channel having a cross-section corresponding to the cross-section of the billet and being continuous with and oriented at an angle relative to the first channel; repeating the steps of insertion and extruding the billet; dynamically testing a penetrator and determining an angle between adiabatic shear bands and a penetrator axis; forming an angle between the channels twice as much as the angle between the adiabatic shear bands and the penetrator axis; perforating a total of four steps of the inserting and extruding the billet with conversation of direction at each extrusion step and rotation of the billet 180° about its longitudinal axis before the insertion of the billet into the first channel at a second one of the steps of extrusion and at a fourth one of the steps of extrusion; forming a penetrator from the billet by cutting off a defected end of the billet, marking cutting planes on the surface of the billet, and locating a penetrator forward end at the marked planes onto the surface of the billet.

9. A method of processing billets of tungsten heavy alloys composed essentially of tungsten grains bonded by a matrix phase, for kinetic energy penetrators displaying adiabatic shear bands under impact and having improved ballistic performance, the method comprising the steps of inserting a billet into a first channel having a cross-section of the billet; extruding the billet from the first channel into a second channel having a cross-section corresponding to the cross-section of the billet and being continuous with and oriented at an angle relative to the first channel; repeating the steps of insertion and extruding the billet; dynamically testing a penetrator and determining an angle between adiabatic shear bands and a penetrator axis: forming an angle between the channels twice as much as the angle between the adiabatic shear bands and the penetrator axis; performing a total of four steps of the inserting and extruding the billet with conservation of direction at each extrusion step and rotation of the billet 180° about its longitudinal axis before the insertion of the billet into the first channel at a second one of the steps of extrusion and at a fourth one of the steps of extrusion; forming multiple penetrators from the billet by cutting off a measured piece of the billet, marking cutting planes on the surface of each of the billet pieces, and locating each penetrator forward end at the marked planes on the surface of each billet piece.

* * * * *